US006527312B1

(12) United States Patent
Jackovino et al.

(10) Patent No.: US 6,527,312 B1
(45) Date of Patent: Mar. 4, 2003

(54) SHIPPING CONTAINER SEAL

(76) Inventors: John Jackovino, 289 Midway Ave., Fanwood, NJ (US) 07023; Vincent MacNair, 408 Harrier Dr., Monroe Township, NJ (US) 08831

( * ) Notice: Subject to any disclaimer, the term of this patent is extended or adjusted under 35 U.S.C. 154(b) by 0 days.

(21) Appl. No.: 10/013,706

(22) Filed: Dec. 13, 2001

(51) Int. Cl.[7] ..... E05C 19/08
(52) U.S. Cl. ..... 292/282; 70/56; 70/211
(58) Field of Search ..... 70/54–56, 101, 70/201–203, 211, 212, 417; 292/307 R, 240, 282, 286

(56) References Cited

U.S. PATENT DOCUMENTS 412,083 A 10/1889 Gillespie ..... 151/2 A
4,010,788 A 3/1977 Van Gompel ..... 151/2 A
4,592,579 A 6/1986 Burnett ..... 292/327
4,802,700 A * 2/1989 Stevenson et al. ..... 292/327
4,898,008 A * 2/1990 Eberly ..... 292/DIG. 32
5,118,149 A * 6/1992 Emmons ..... 292/205
5,168,258 A * 12/1992 Radke ..... 340/542
5,743,118 A * 4/1998 Anderson ..... 292/205
5,769,470 A * 6/1998 Toyomura ..... 292/287
6,233,984 B1 * 5/2001 Blehi, III ..... 70/2
6,357,266 B1 * 3/2002 Van Buren ..... 70/211

* cited by examiner

*Primary Examiner*—Gary Estremsky
(74) *Attorney, Agent, or Firm*—Patent & Trademark Services; Thomas Zack; Joseph H. McGlynn

(57) ABSTRACT

A seal for a container. The seal is banana-shaped and is inserted over a container handle to make it impossible to move the handle without breaking the seal.

10 Claims, 2 Drawing Sheets

SHIPPING CONTAINER SEAL

BACKGROUND OF THE INVENTION

This invention relates in general to a door seal, and in particular to a door seal for a shipping container handle.

DESCRIPTION OF THE PRIOR ART

Seal devices used to indicate tampering with a lock are known in the prior art. For example, U.S. Pat. No. 412,083 to Gillespie discloses a seal lock having a U-shape which is inserted through aligned apertures in a door hasp.

U.S. Pat. No. 4,010,788 to Van Gompel discloses a bolt seal having a bent L-shape which is inserted through aligned apertures in a door hasp.

U.S. Pat. No. 4,592,579 to Burnett discloses a shipping container seal which has a curved male seal which is inserted into a female sleeve. The seal is inserted through aligned apertures in a door hasp.

U.S. Pat. No. 5,118,149 to Emmons discloses a protector for a hasp of a shipping container which has a straight seal inserted through aligned apertures of a door hasp.

The present invention is directed to a seal for a container which is a banana shaped device that is inserted over a handle making it impossible to move the handle without breaking the seal, all as will be detailed in the specification that follows hereafter.

SUMMARY OF THE INVENTION

This invention relates to a seal for a shipping container. The seal is banana-shaped and is inserted over a container handle to make it impossible to move the handle without breaking the seal.

It is the primary object of the present invention to provide for an improved seal for a door handle.

Another object is to provide for such a seal that fits over a door handle through an end cover to prevent the handle from being pivoted without breaking the seal.

These and other objects and advantages of the present invention will become apparent to readers from a consideration of the ensuing description and the accompanying drawings.

DESCRIPTION OF THE PREFERRED EMBODIMENT

Figure 1:
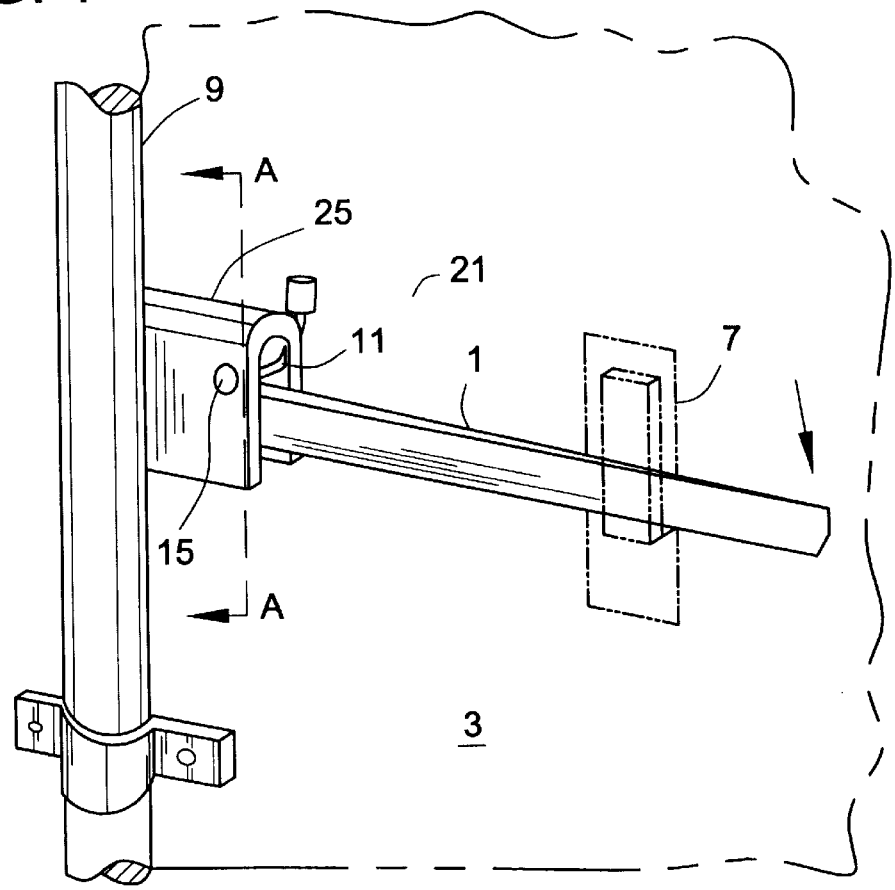
FIG. 1 is a perspective view of the present invention showing the handle for a door in a down position.

FIG. 1 is a perspective view of the present invention showing the handle 1 for a shipping container door 3, with the handle 1 in a down or closed position. The door 3 could be a rear door on a tractor trailer truck or any other conventional shipping container. The handle 1 is pivoted at one end (rear) by a pivot pin 17 (shown in FIG. 2) that fits through the handle end and the walls of the cover 25, and allows the handle to be moved from a down (closed) position to an up (opened) position. The handle 1 and the vertical door locking bar 9 are conventional and, therefore, no further description is necessary or will be given.

A U-shaped cover 25 fits over the rear end of the handle (to the left as shown in FIG. 1)and is attached to the locking bar 9 by any conventional means, such as, but not limited to, welding. The other end of handle 1 (to the right as shown in FIG. 1)has a free end which is inserted into a conventional latch mechanism 7 when the handle is moved into a down or closed position. To open the door 3 a user unlatches mechanism 7, lifts the handle 1 and then rotates the handle about ninety degrees from the door 3. When the handle 1 is so moved, the attached locking bar 9 is lifted vertically, and rotated about its vertical axis to release the bar from its securing mechanism. The locking bar 9 and the securing mechanism are conventional.

In order to prevent unauthorized persons from moving the handle 1 to the open position, and gaining entry into contents of the tractor trailer, locks and/or seals are conventionally used. If the seal is broken, this is an indication that the door handle and/or latch have been tampered with.

Figure 2:
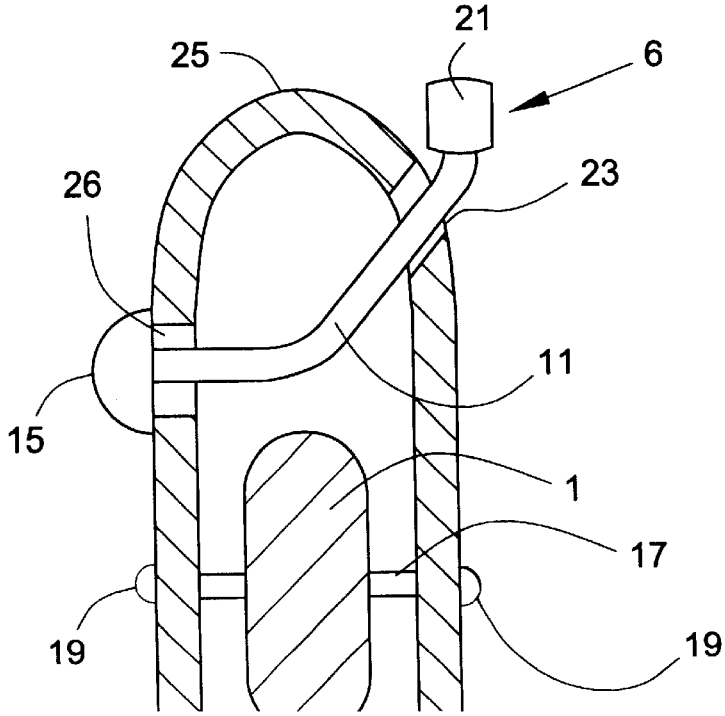
FIG. 2 is a cross section view taken on line A—A of FIG. 1 looking towards the pivoted end of the handle.

The present invention is directed to a seal that is secured adjacent the rear end of the handle 1 or the handle end attached to the locking bar 9. The seal of the present invention works in conjunction with the cover 25 to prevent the handle 1 from being moved into the up (open) position and then rotated . As can be seen in FIG. 2, with the seal 6 in place there is not enough room between the top of the handle 1 and the bottom of the bottom of the top of the cover 25 for the handle 1 to be lifted and pivoted to the open position. If the seal 6 is removed from cover 25 there is enough room between the top of the handle 1 and the cover 25 for the handle to be pivoted and then rotated along with the locking bar 9.

The seal 6 of the present invention comprises a male member having one segment 11 and two enlarged ends 15, 21 which work in conjunction with apertures in the cover 25. Most of the segment 11 is within cover 25 and extends over the top of the handle 1. Normally, the opposite front end, or free end, of the handle is held in a down position by the conventional latch mechanism 7. The latch mechanism 7 is used to lock the handle in a down position when the seal of the present invention is employed, such as when a trailer truck is in transit or in storage.

Segment 11 extends upwardly in a curved manned within the cover 25. The seal 6 has an enlarged head 15 on one end which bears against a side wall of cover 25, and prevents the seal 6 from being pulled through a hole in the cover from left to right, as seen in FIG. 2. Head 15 is semi-hemispherical in shape to make it difficult to grasp with a tool. The general shape of the segment 11 is an upward curved shaped which may be described as banana shaped.

FIG. 2 is a cross sectional view taken along line A—A of FIG. 1 looking towards the pivoted end of the handle. A pivot pin 17 extends through the rear end of handle 1 and allows the free handle end to be moved upwardly in order to open the door. The ends of the pin 17 are mounted into the walls of the existing cover 25 and have enlarged ends 19 to maintain the pin in place.

The seal 6 has an enlarged head 15 on one end and a large end cap 21 that can be placed on the free end of segment 11. Both head 15 and cap 21 are outside of cover 25. The head 15 and the cap 21 prevent the segment 11 from passing through cover holes 23 and 26 in the walls of cover 25. The cap 21 may take on different configurations as best shown in FIGS. 2, 3 and 4.

Figure 3:
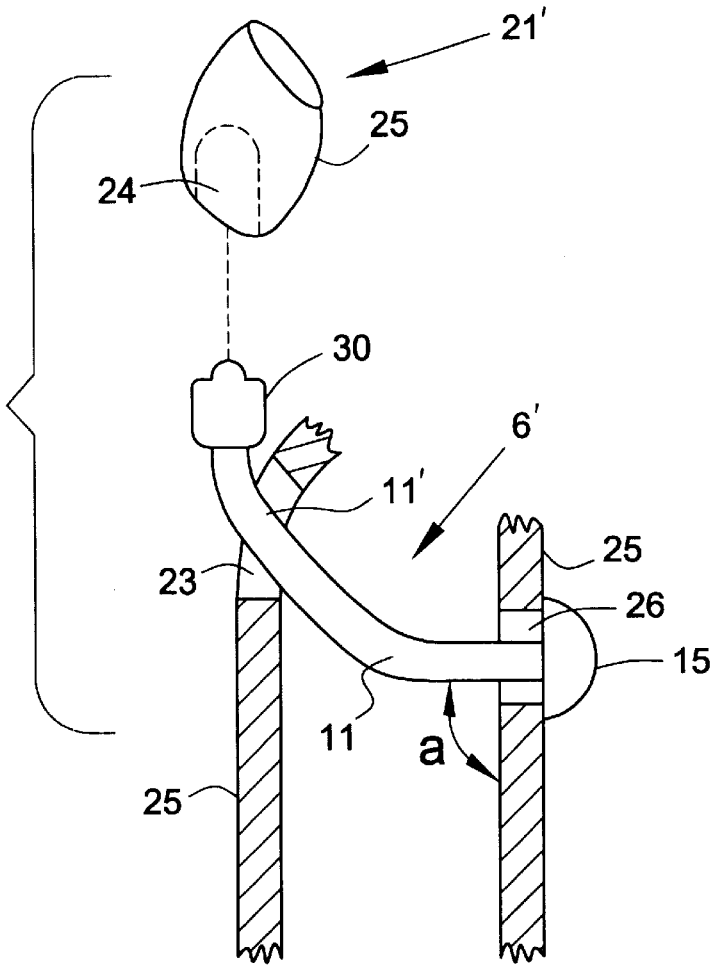
FIG. 3 show a perspective view of a modified seal with a different shaped end.
Figure 4:
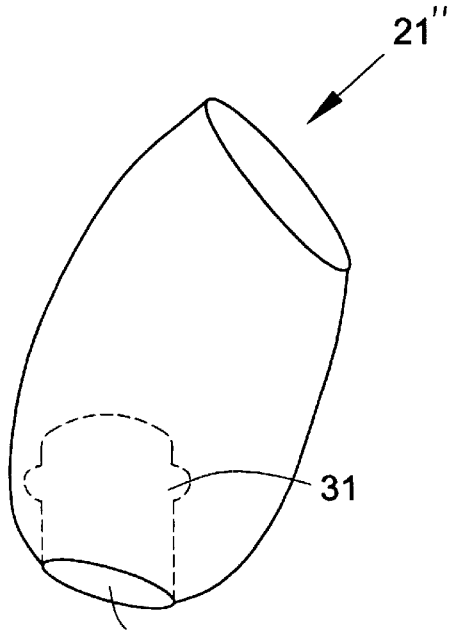
FIG. 4 show a perspective view of a modified seal end.

FIG. 3, is a reversed view from FIG. 2, which shows a slightly modified seal 6' in which the segment 11' is somewhat more curved than the FIGS. 1 and 2 embodiment. Cover holes 23 and 26 (see FIGS. 2 and 3) on the opposite sides of cover 25 permit the segment 11' to be inserted through cover 25. When the either of the seals 6 or 6' is inserted through the holes in cover 25, a lower surface portion of seal segment 11' bears directly against the top surface of handle 1 (not shown in FIG. 3, but shown in FIG. 2), thereby preventing the handle 1 from being pivoted upwardly to an unlocked position without first breaking the seal.

Many of the described components, by themselves, are conventional. This includes the handle 1, locking bar 9, and the handle latch mechanism 7.

The seal segment 11 and 11' have end caps 21 (FIG. 2), 21' (FIG. 3) and 21" (FIG. 4) each of which have an aperture 24 in one end.

The end of segment 11' has a projection 30 which is larger than the inside diameter of wall aperture 23 (similar structure is used with the FIG. 1 and FIG. 2 embodiment, but are not shown in FIG. 1 and FIG. 2). When the caps 21, 21',21" are forced onto the end of segment 11', the cap will be secured thereto and can not be removable without damaging the seal. If desired the internal surface of aperture 24 can have an indentation or groove 31 (see FIG. 4) to receive the projection 30.

The banana shaped curvature of the seals 6 or 6' allow the end seal segments 11, 11' to be removed from the cover 25 with the end cap 21, 21' or 21" being both visible and accessible.

In one embodiment of the invention, the segment 11' has a diameter of ⅜ of an inch, with the angle a (see FIG. 3) between the seal and wall being about 110 degrees, the total length of segment 11' was 2 ½ inches. The end 30 of the segment 11' has a diameter of 1 inch and the internal diameter of aperture 24, into which end 30 is forced is only ¼ of an inch.

In order to use the present invention, a user would first place the handle in the down or closed position, with the free (front ) end of the handle in the latch mechanism 7. Next the segment 11 would be inserted through hole 23 and hole 26 until the head 15 engages one side of cover 25. Next, a cap, such as cap 21, would be forced onto the end 30 of segment 11, completing the seal 6 or 6'. As long as the seal is in place it will not be possible to move the handle 1 to the open position without damaging the seal.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A sealing system for a container comprising:

a handle having a first pivotally mounted end and a second end for opening a door of a container, a cover substantially covering the first end of the handle and not the second end, said handle being moved from a first position in which said door is locked, to a second position in which said door is open, seal means extending through said cover for preventing said handle from being moved from said first position to said second position without breaking the seal means, said seal means having a portion positioned within said cover that bears against a portion of the first end of said handle when said handle is moved to said second position, and said seal means having an enlarged first end outside of the cover, said seal means having a second end external of said cover, and said second end having a free end, and cap means attached to said second end for preventing said seal means from being removed from said cover.

2. The sealing system as claimed in claim 1, wherein said seal means is curved upwardly along a length of the seal means.

3. The sealing system as claimed in claim 2, wherein said free end has an enlarged portion thereon.

4. The sealing system as claimed in claim 3, wherein said free end has a diameter, and said cap means has an aperture smaller than the diameter of said free end to forcibly receive and retain said free end.

5. The sealing system as claimed in claim 3, wherein said free end has a projection thereon, and said free end and said projection has a first dimension, and said cap means has an aperture, and said aperture has a second dimension, and said first dimension is larger than said second dimension.

6. The sealing system as claimed in claim 3, wherein said free end has a projection thereon, and said free end and said projection has a first dimension, and said cap means has an aperture, and said aperture has a recess in a side wall of said aperture, and said aperture and said recess have a second dimension, and said first dimension is slightly larger than said second dimension.

7. The sealing system as claimed in claim 1, wherein said cover has a pair of opposite side walls, said seal means extends through apertures in each of said side walls, said seal means having a portion within the cover, said portion is curved upwardly toward a top of said cover.

8. The sealing system as claimed in claim 1, wherein said portion extends upwardly at an angle greater than 100 degrees relative to said side walls.

9. The sealing system as claimed in claim 1, wherein said sealing system further includes vertical bar means for latching said door, and said cover is secured to said vertical bar, and said handle has the first end secured to said vertical bar means and the second end is a free end which engages a latch.

10. A sealing system for a container comprising:

a handle for opening a door of a container, said handle having a first pivotally-mounted end and a second free end, said second end being opposite said first end, a cover extending over a portion of said handle including said first end, said handle being pivotally moved from a first position in which said door is locked, to a second position in which said door is open, seal means extending through said cover for preventing said handle from being moved from said first position to said second position without breaking the seal, said seal means having a portion positioned within said cover that bears against a portion of said handle when said handle is moved to said second position, and said seal means having an enlarged first end outside of the cover, said seal means having a second end external of said cover, and said second end having a free end, and cap means attached to said second end for preventing said seal means from being removed from said cover.

* * * * *